US006874467B2

(12) United States Patent
Hunt et al.

(10) Patent No.: US 6,874,467 B2
(45) Date of Patent: Apr. 5, 2005

(54) FUEL DELIVERY SYSTEM FOR AN INTERNAL COMBUSTION ENGINE

(75) Inventors: Frank Warren Hunt, West Bloomfield, MI (US); Shigeru Oho, Farmington Hills, MI (US); Ayumu Miyajima, Farmington Hills, MI (US)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/213,794

(22) Filed: Aug. 7, 2002

(65) Prior Publication Data

US 2004/0025837 A1 Feb. 12, 2004

(51) Int. Cl.[7] ..... F02D 41/06; F02D 9/00

(52) U.S. Cl. ..... 123/339.27; 123/399; 123/442; 123/568.21; 123/491

(58) Field of Search ..... 123/339.23, 491, 123/442, 568.21, 399, 336, 339.27

(56) References Cited

U.S. PATENT DOCUMENTS

| | | | | | |
|---|---|---|---|---|---|
| 3,338,568 | A | * | 8/1967 | Magoletsi | 261/145 |
| 3,807,367 | A | * | 4/1974 | Lamm | 123/207 |
| 4,083,183 | A | | 4/1978 | Yaegashi et al. | 60/290 |
| 4,104,989 | A | | 8/1978 | Resler | 123/32 |
| 4,211,201 | A | * | 7/1980 | Sumiyoshi et al. | 123/463 |
| 4,214,561 | A | * | 7/1980 | Matsumoto et al. | 123/432 |
| 4,304,211 | A | | 12/1981 | Tezuka et al. | 123/585 |
| 4,344,396 | A | * | 8/1982 | Yamada | 123/337 |
| 4,351,304 | A | | 9/1982 | Schweizer | 123/585 |
| 4,408,581 | A | * | 10/1983 | Pfalzgraf et al. | 123/337 |
| 4,424,785 | A | | 1/1984 | Ishida et al. | 123/479 |
| 4,513,700 | A | * | 4/1985 | Hayashida | 123/179.16 |
| 4,519,367 | A | | 5/1985 | Nomura | 123/440 |
| 4,683,854 | A | | 8/1987 | Goulet | 123/478 |
| 4,700,676 | A | * | 10/1987 | Harashima et al. | 123/339.14 |
| 4,768,494 | A | * | 9/1988 | Hale | 123/579 |
| 4,827,884 | A | * | 5/1989 | Cook | 123/336 |
| 5,012,789 | A | | 5/1991 | Spicuzza et al. | 123/587 |
| 5,119,794 | A | | 6/1992 | Kushida et al. | 123/549 |
| 5,299,548 | A | | 4/1994 | Beall | 123/586 |
| 5,465,701 | A | | 11/1995 | Hunt | 123/531 |
| 5,482,023 | A | | 1/1996 | Hunt et al. | 123/491 |
| 5,509,397 | A | | 4/1996 | Hoshi | 123/585 |
| 5,526,789 | A | * | 6/1996 | Stein et al. | 123/432 |
| 5,529,035 | A | | 6/1996 | Hunt et al. | 123/179.15 |
| 5,570,674 | A | | 11/1996 | Izumiura et al. | 123/690 |
| 5,586,539 | A | | 12/1996 | Yonekawa et al. | 123/458 |
| 5,598,826 | A | | 2/1997 | Hunt et al. | 123/491 |
| 5,657,731 | A | * | 8/1997 | Kim | 123/336 |
| 5,832,893 | A | | 11/1998 | Kamura et al. | 123/305 |
| 5,850,822 | A | | 12/1998 | Romann et al. | 123/549 |
| 5,873,354 | A | | 2/1999 | Krohn et al. | 123/549 |
| 5,894,832 | A | * | 4/1999 | Nogi et al. | 123/491 |
| 5,934,260 | A | | 8/1999 | Gadkaree et al. | 123/520 |
| 6,058,915 | A | * | 5/2000 | Abidin et al. | 123/546 |
| 6,109,247 | A | | 8/2000 | Hunt | 123/549 |
| 6,152,105 | A | * | 11/2000 | Nishimura et al. | 123/339.11 |
| 6,256,982 | B1 | | 7/2001 | Kerns | 60/283 |
| 6,279,549 | B1 | | 8/2001 | Hunt | 123/549 |
| 6,286,478 | B1 | | 9/2001 | Atago et al. | 123/306 |
| 6,334,418 | B1 | | 1/2002 | Hubbard | 123/179.21 |
| 6,341,593 | B2 | | 1/2002 | Kamimura et al. | 123/337 |
| 6,349,699 | B1 | * | 2/2002 | Wild et al. | 123/336 |
| 6,360,160 | B1 | * | 3/2002 | Kanamaru et al. | 701/104 |
| 6,367,446 | B1 | * | 4/2002 | Kanamaru et al. | 123/339.12 |
| 6,508,236 | B2 | * | 1/2003 | Amou et al. | 123/545 |
| 6,543,412 | B2 | * | 4/2003 | Amou et al. | 123/337 |
| 6,742,497 | B1 | * | 6/2004 | Kanamaru et al. | 123/339.11 |

* cited by examiner

*Primary Examiner*—Hai Huynh
(74) *Attorney, Agent, or Firm*—Gifford, Krass, Groh, Sprinkle, Anderson & Citkowski, P.C.

(57) ABSTRACT

A fuel delivery system having an electronically controlled throttle valve operatively disposed in an intake manifold. An idle speed control valve is operatively disposed within a bypass gas flow passageway. A control system controls the actuation of both the throttle valve and idle speed control valve to control the delivery of a combustible charge to the internal combustion engine to maximize engine efficiency and minimize noxious emissions.

12 Claims, 13 Drawing Sheets

FUEL DELIVERY SYSTEM FOR AN INTERNAL COMBUSTION ENGINE

BACKGROUND OF THE INVENTION

I. Field of the Invention

The present invention relates generally to a fuel delivery system for an internal combustion engine.

II. Description of the Prior Art

In conventional gasoline fueled internal combustion engines of the type used in the automotive industry, a manually actuated throttle body is fluidly disposed in series with the intake manifold upstream from the engine combustion chamber(s). This manually controlled throttle is mechanically linked to the accelerator pedal in the automotive vehicle such that depression and release of the accelerator pedal respectively opens and closes the throttle plate of the throttle valve. The opening and closure of the throttle plate within the intake manifold, of course, controls the mass air flow rate through the intake manifold.

While the previously known manually actuated throttles for internal combustion engines have operated satisfactorily during high engine RPM operating conditions, such manually controlled throttles have been inadequate by themselves to control the air flow rate to the internal combustion chambers of the engine during an idle and/or cold start operating condition. The inability of the manually actuated throttles to control the air flow rate during an idle and/or cold start engine operating condition arises primarily through government emission standards which require increasingly lower levels of noxious emissions from the engine during all engine operating conditions, including both idle and cold start operating conditions.

In order to rectify this inadequacy of the manually controlled throttles for internal combustion engines, it has been the previous practice to provide a bypass passageway around the manual throttle such that the bypass passageway includes an inlet upstream from the manual throttle and an outlet downstream from the manual throttle. Thus, during both idle and cold start operating conditions, the air flow to the engine is provided through the bypass passageway, rather than the main intake manifold.

In order to control the air flow through the bypass passageway during both idle and cold start operating conditions, these previously known fuel delivery systems have utilized an idle speed control valve fluidly connected in series with the bypass gas flow passageway. A typically microprocessor based engine control unit (ECU) then controls the actuation of the idle speed control valve between its fully closed and fully open position to accordingly vary the gas flow through the bypass gas flow passageway. Typically, these idle speed control valves are linear valves and thus may be variably opened between their fully closed and fully open positions.

In order to accurately control the fuel/air mixture to the engine during a cold start operating condition, it has also been previously known to provide a cold start fuel injector within the bypass passageway. This cold start fuel injector provides fuel to the engine in lieu of the multi-point fuel injectors utilized during a cold engine condition. The use of the cold start fuel injector enables accurate control of the fuel/air mixture by the ECU during the cold start operating condition thereby minimizing noxious emissions from the engine. Additionally, many of these cold start fuel injectors include heating elements of one sort or another positioned within the bypass passageway to enhance the vaporization of the fuel in the bypass passageway and prior to its introduction into the internal combustion engine for better fuel economy, better engine efficiency and reduced noxious emissions.

One disadvantage, however, of utilizing both a manually operated throttle as well as the idle speed control valve is that the idle speed control valve necessarily increases the overall cost of the fuel delivery system above the use of a manually controlled throttle by itself. However, it has been previously necessary to utilize an idle speed control valve in combination with a manually actuated throttle in order to meet government emission standards.

In recent years, electronically controlled throttle valves have been introduced in which the actuation of the throttle valve, typically a throttle plate in the intake manifold, is controlled by an electric motor. The ECU, in turn, controls actuation of the electric motor in response not only to electronic sensors associated with the accelerator pedal for the vehicle, but also in response to various engine operating conditions and engine parameters. Since the ECU is capable of accurately controlling the degree of opening or closure of the throttle during all engine operating conditions, the electronically controlled throttle valve is able to replace both the previously used manual throttle valve as well as the idle speed control valve. The utilization of electronically controlled throttle valves not only achieves low engine emissions but also better traction control and vehicle cruise control.

In order to achieve the accurate control of air flow through the intake manifold necessary to meet governmental emission standards, it has been necessary to manufacture the electronically controlled throttle valve with its associated throttle body to a high degree of accuracy. This, in turn, has increased the overall manufacturing cost of the electronically controlled throttle valve and its associated body. Furthermore, it is difficult to maintain this high degree of accuracy for the electronically controlled throttle valve and its associated body over the useful life of the internal combustion engine.

SUMMARY OF THE PRESENT INVENTION

The present invention provides a fuel delivery system for an internal combustion engine which overcomes all of the above-mentioned disadvantages of the previously known systems.

In brief, the fuel delivery system of the present invention is provided for use with an internal combustion engine of the type having an intake manifold which is selectively fluidly connected to one or more combustion chambers through conventional intake valves. A bypass gas flow passageway also has its inlet open to the intake manifold and an outlet open to the intake manifold downstream from its inlet.

An electronically controlled throttle valve is operatively disposed in the intake manifold. The throttle valve is linearly movable between an open and closed position to control the air flow through the intake manifold.

An idle speed control valve is operatively disposed in series in the bypass gas flow passageway. This idle speed control valve is also movable between an open and a closed position to control the air flow through the bypass gas flow passageway. Additionally, the throttle valve, when in its closed position, closes air flow through the intake manifold at a position immediately downstream from the intake for the bypass gas flow passageway. Thus, when the throttle valve is in its closed or nearly closed position, the air flow passageway through the bypass gas flow passageway is controlled primarily by the idle speed control valve.

An electronic control system or unit (ECU) controls both the actuation of the throttle valve as well as the idle speed control valve. Preferably, the ECU is microprocessor based.

Optionally, a cold start fuel injector is associated with the bypass gas flow passageway. The ECU controls the actuation of the cold start fuel injector to inject fuel into the bypass gas flow passageway during a cold engine starting condition. Conventional heaters are optionally positioned within the bypass passageway to enhance vaporization of the fuel injected by the cold start fuel injector.

In an alternate form of the invention, first and second electronically controlled throttle valves are positioned within the intake manifold. The first throttle valve controls the air flow through the intake manifold while the second throttle valve controls the diversion of air into and through the bypass gas flow passageway. The first and second electronically controlled throttle valves may be either mounted in series in the intake manifold or, alternatively, in parallel with the first throttle valve controlling air flow through the intake manifold and the second throttle valve controlling air flow into the bypass gas flow passageway.

The ECU controls the actuation of both the first and second electronically controlled throttle valve. Additionally, a cold start fuel injector is optionally associated with the bypass gas flow passageway to inject fuel into the bypass gas flow passageway during a cold engine operating condition.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
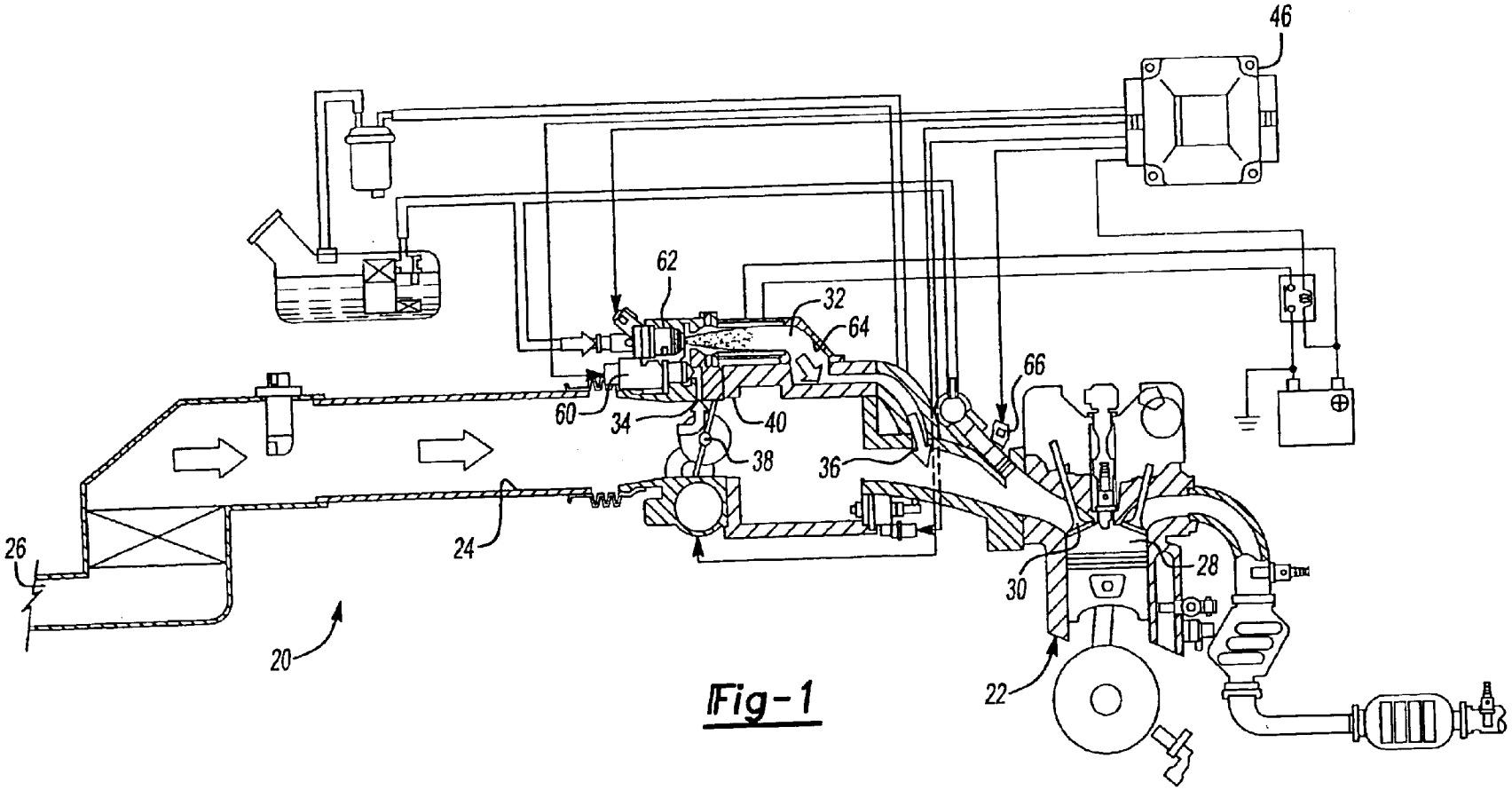
FIG. 1 is a diagrammatic view illustrating a preferred embodiment of the present invention.

With reference first to FIG. 1, a first preferred embodiment of the fuel delivery system 20 is there shown for use with an internal combustion engine 22 (illustrated only diagrammatically). The internal combustion engine 22 includes an intake manifold 24 having an intake end 26 through which air is inducted. The intake manifold 24, in the conventional fashion, fluidly connects the intake 26 to a combustion chamber 28 of the internal combustion engine 22 via an intake valve 30.

Still referring to FIG. 1, a bypass gas flow passageway 32 has an inlet 34 open to the intake manifold 24. Similarly, the bypass passageway 32 has an outlet 36 which is open to the intake manifold 24 downstream from the inlet 34.

An electronically controlled throttle valve 38 is operatively positioned within the intake manifold 24. The throttle valve 38 is a linear valve movable between an open position and a closed position (illustrated in FIG. 1) to control the air flow through the intake manifold 24. Furthermore, in its closed position, a throttle plate 40 of the throttle valve 38 is disposed across and substantially closes the intake manifold 28 immediately downstream from the intake 34 of the bypass passageway 32. Thus, when in its closed position, the throttle valve 38 diverts air flow into and through the bypass passageway 32 in a fashion to be subsequently described in greater detail.

Figure 2:
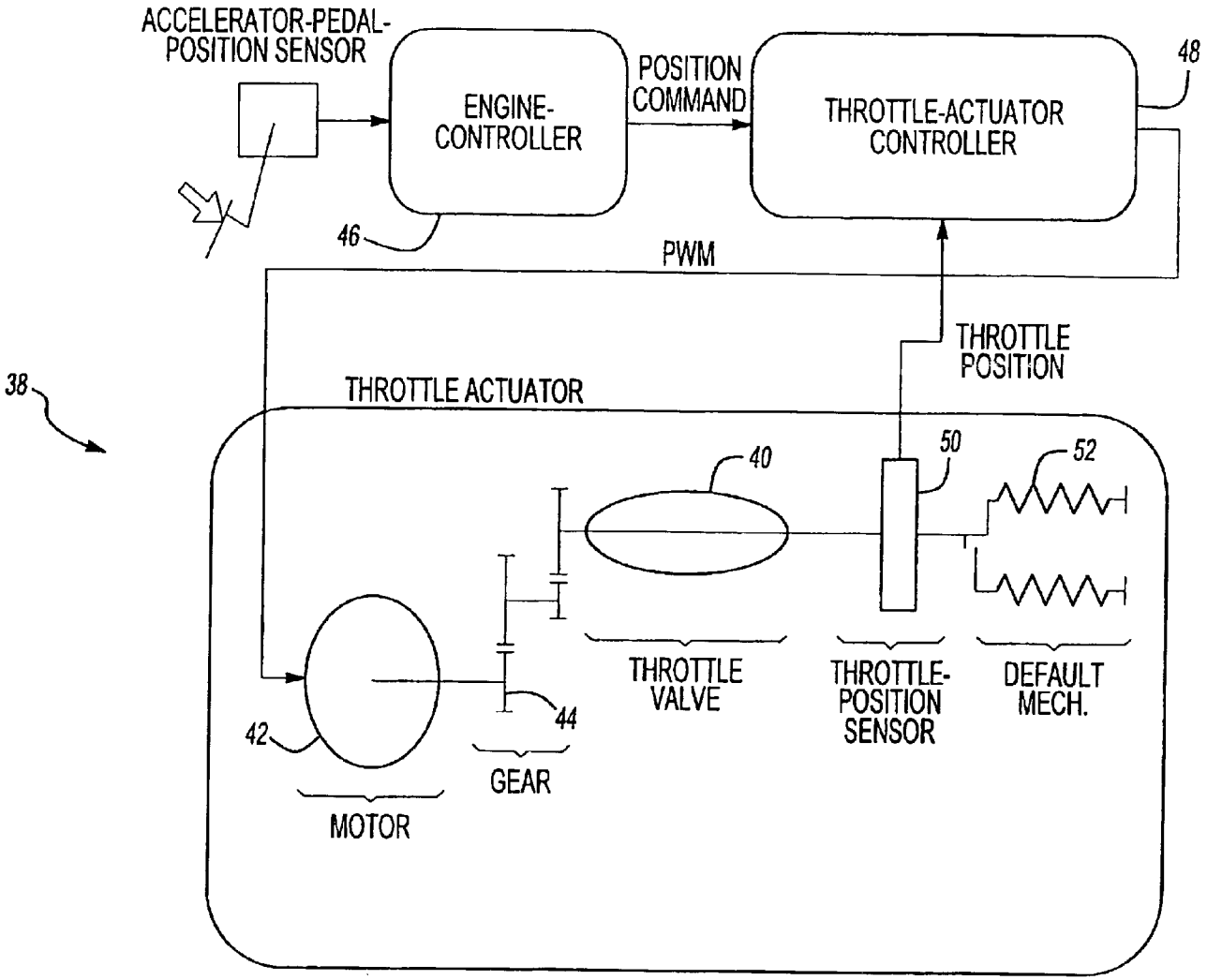
FIG. 2 is a diagrammatic view illustrating a conventional electronically controlled throttle valve.

With reference now to FIG. 2, the electronic throttle valve 38 is there shown diagrammatically and includes both the throttle plate 40 which selectively opens and closes the intake passageway 24 as a function of the angle of opening of the throttle plate 40. A motor 42, such as a DC servo motor, is mechanically coupled to the throttle plate 40 through a gear arrangement 44, illustrated only diagrammatically, so that the position of the motor 42 controls the position of the valve plate 40.

An electronic control unit (ECU) 46 controls the actuation of the motor 42 through a throttle actuator controller 48. A throttle position sensor 50 detects the actual position of the throttle plate 40 and generates an electrical output signal representative of the position of the throttle valve plate 40. This electrical signal is coupled as a feedback signal to the throttle actuator controller 48 or, optionally, to the ECU 46. A default mechanical mechanism 52 (illustrated only diagrammatically) is also mechanically coupled to the throttle valve plate 40 to set a default position of the throttle plate 40 in the event of failure of the electronic throttle control.

Since the ECU 46 controls the actuation of the electronically controlled throttle valve 38, the opening of the throttle plate 48 may be accurately varied by the ECU 46 as required to achieve low emissions, efficient engine operation, traction control, vehicle speed control and the like.

With reference again to FIG. 1, the fuel delivery system 20 of the present invention further includes an idle speed control valve 60 which is operatively positioned in series with the bypass passageway 32. Preferably, the idle speed control valve 60 is fluidly coupled with the bypass passageway 32 immediately downstream from the inlet 34.

Preferably, the idle speed control valve 60 is a linear valve so that it may be variably opened between a fully closed and fully opened position. The ECU 46 is electrically connected with the idle speed control valve 60 to control the actuation, i.e. the degree of opening, of the idle speed control valve 60.

Optionally, a cold start fuel injector 62 has its outlet open to the bypass passageway 32. An exemplary cold start fuel injector is disclosed in U.S. Pat. No. 6,279,549, which issued on Aug. 28, 2001, which patent is incorporated by reference herein in its entirety. During a cold start engine operating condition and, optionally, during an idle speed air flow condition, the ECU 46 actuates the cold start fuel injector 32 to inject fuel into the bypass passageway 32. The bypass passageway 32 may also include one or more heating elements 64 to enhance the vaporization of fuel injected into the bypass passageway 32 by the cold start fuel injector 62.

In operation and assuming an idle speed engine operating condition, the throttle valve 38 is in the position shown in FIG. 1 in which the throttle valve 38 substantially closes the intake passageway 24. In doing so, the throttle plate 40 of the throttle valve 38 diverts inducted air into and through the bypass passageway 32. Thus, during an idle engine operating condition, air is inducted from the intake 26 of the intake manifold 24, through the inlet 34 and bypass passageway 32 and through the bypass passageway outlet 36 to the combustion chamber 28. During a cold start engine operating condition, the cold start fuel injector 62 may also be actuated by the ECU 46 to provide fuel to the engine combustion chamber 28 in lieu of multi-point fuel injectors 66 which are employed during a warm engine operating condition.

Since the opening of both the idle speed control valve 60 as well as the throttle valve 38 may be electronically controlled, the air flow to the engine combustion chamber 28 together with the fuel charge may be accurately controlled by adjusting the degree of opening of both the electronic throttle valve 38 and idle speed control valve 60 to not only maximize engine efficiency and economy, but also to minimize noxious emissions. The control of the throttle valve 38 and idle speed control valve 60 by the ECU 46 is also employed for traction control, vehicle speed control and the like.

A primary advantage of utilizing both the idle speed control valve 60 and the throttle valve 38, both of which are controlled electronically by the ECU, is that the degree of opening or closure of the idle speed control valve 60 compensates for manufacturing tolerances of the throttle valve 38. As such, high precision manufacture of the throttle valve 38, together with its high manufacturing cost, is avoided.

In order to further reduce the manufacturing cost of the fuel system of the present invention, preferably the bypass passageway 32 as well as the intake passageway 24 are manufactured in a single, one piece body.

Figure 3:
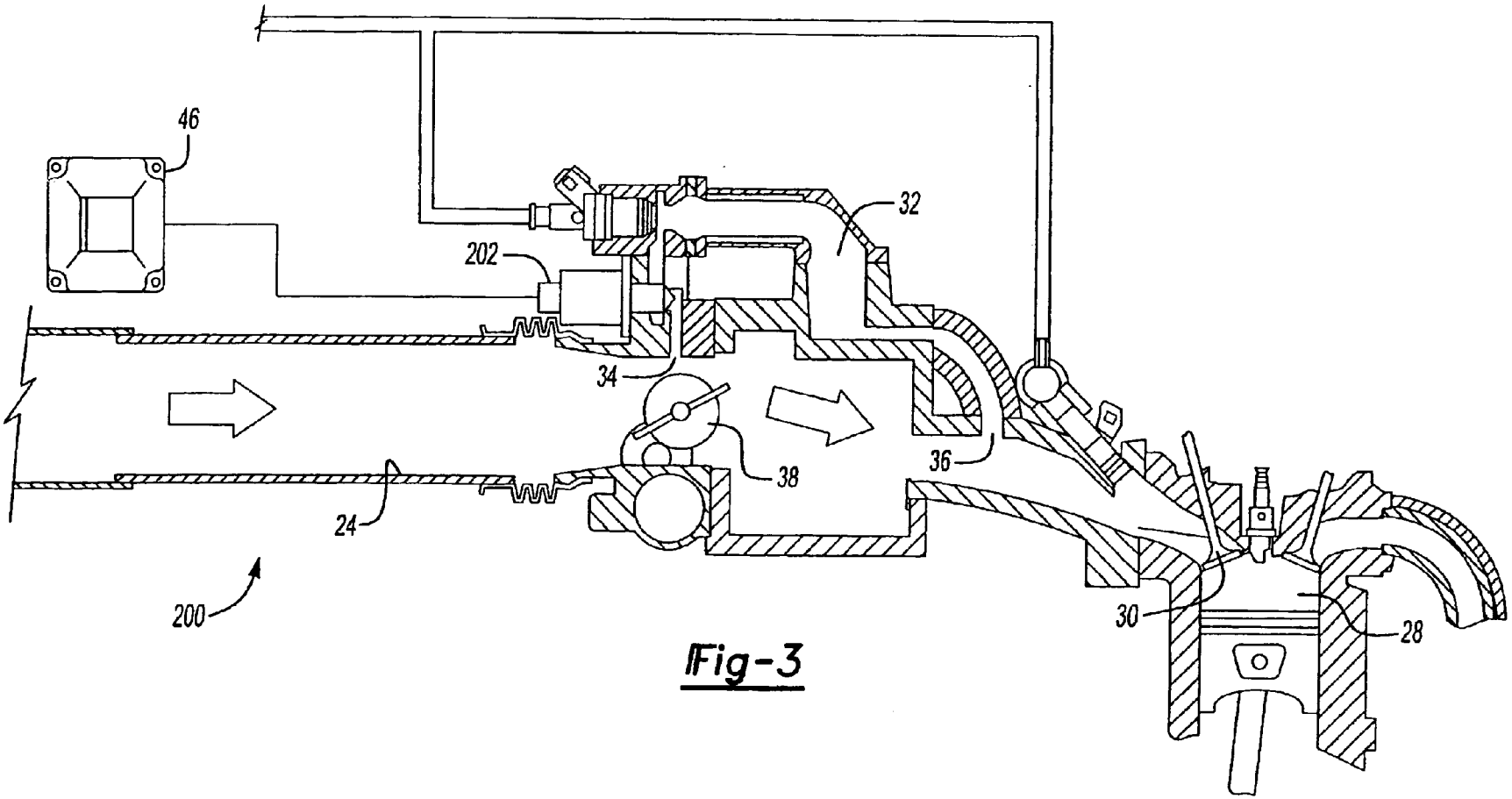
FIG. 3 is a diagrammatic view similar to FIG. 1 but illustrating a modification thereof.

With reference now to FIG. 3, a further preferred embodiment of the fuel delivery system 200 of the present invention is illustrated. The fuel delivery system 200 illustrated in FIG. 3 includes the intake manifold 24 which is fluidly coupled to the engine combustion chamber 28 through the conventional intake valve 30. The bypass gas flow passageway 32, like the embodiment illustrated in FIG. 1, has its inlet 34 open to the intake manifold 24 and its outlet 36 open to the intake manifold 24 downstream from its inlet 34.

As before, the electronically controlled throttle valve 38 is fluidly disposed in series with the intake manifold 24 immediately downstream from the bypass passageway inlet 34. Thus, when in its closed position, the throttle valve 38 diverts air flow into and through the bypass passageway 32.

The embodiment of the invention illustrated in FIG. 3, however, differs from the embodiment of the invention illustrated in FIG. 1 in that the variably actuated idle speed control valve 60 of the FIG. 1 embodiment is replaced by an idle speed control valve 202 that is either fully open or fully closed, i.e. an on/off valve. The ECU 46 controls the actuation of the valve 202 to regulate the air flow through the bypass passageway 32.

The advantage of the fuel delivery control system 200 illustrated in FIG. 3 is that, due to the simplified construction of the valve 202, manufacturing costs of the FIG. 3 embodiment are less than the fuel delivery system 20 of FIG. 1. However, accurate control of the gas flow through the bypass passageway can still be achieved by the fuel delivery system 200 by control of the duty cycle of the valve 200 by the ECU 46.

Figure 4:
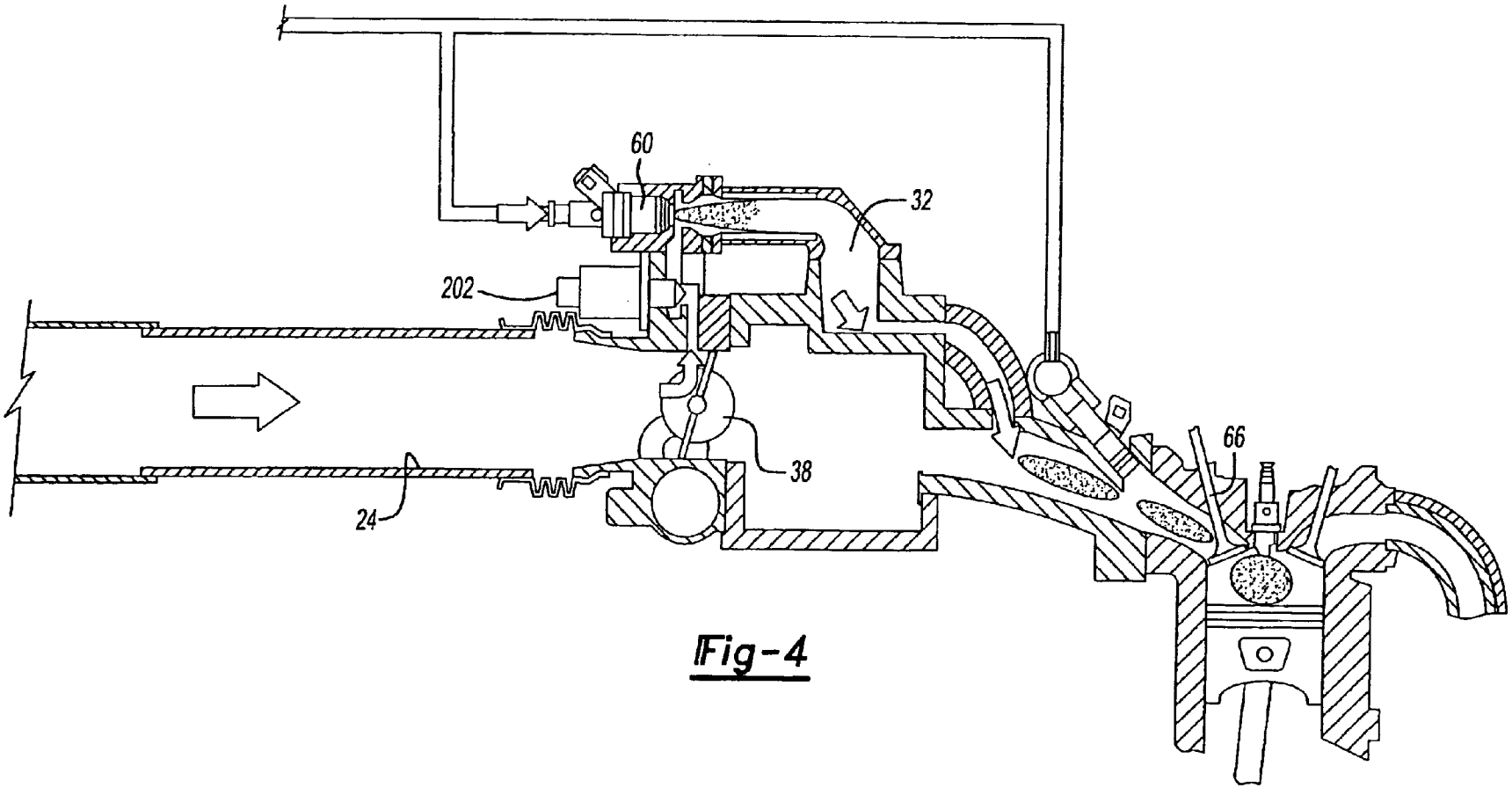
FIG. 4 is a view similar to FIG. 3 but illustrating an idle condition.

With reference now to FIGS. 3 and 4, FIG. 3 illustrates the operation of the fuel delivery system 20 in a non-idle engine operating condition. During this mode, the valve 202 is in the closed position thus preventing gas flow through the bypass passageway 32. The angle of opening of the throttle valve 38 then controls the air flow to the engine combustion chamber 28 during the non-idle condition.

Conversely, during an idle condition as illustrated in FIG. 4, the throttle valve 38 is in the closed position thus diverting inducted air flow through the bypass passageway 32. During such an idle condition, the valve 202 is opened thus permitting air flow through the bypass passageway 32. Additionally, during a cold start engine condition, the cold start fuel injector 60 provides the fuel to the engine in lieu of the multi-point fuel injectors 66. During an idle condition, furthermore, both the duty cycle of the valve 202, as well as the precise angle of opening of the throttle valve 38, is controlled by the ECU 46 to achieve low emissions, improved traction control, cruise control and the like.

Figure 5:
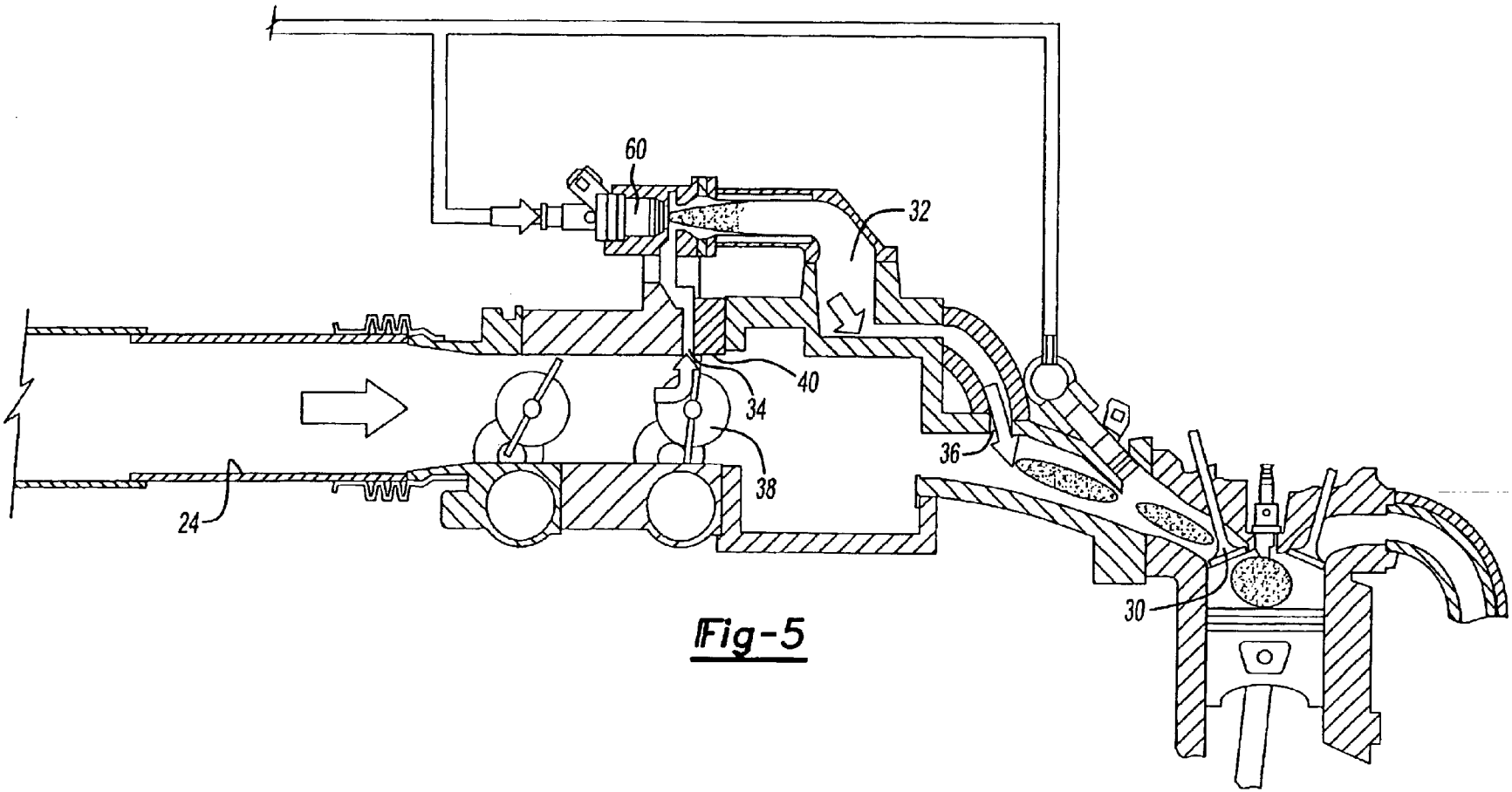
FIG. 5 is a diagrammatic view of a further preferred embodiment of the present invention during an idle condition.
Figure 6:
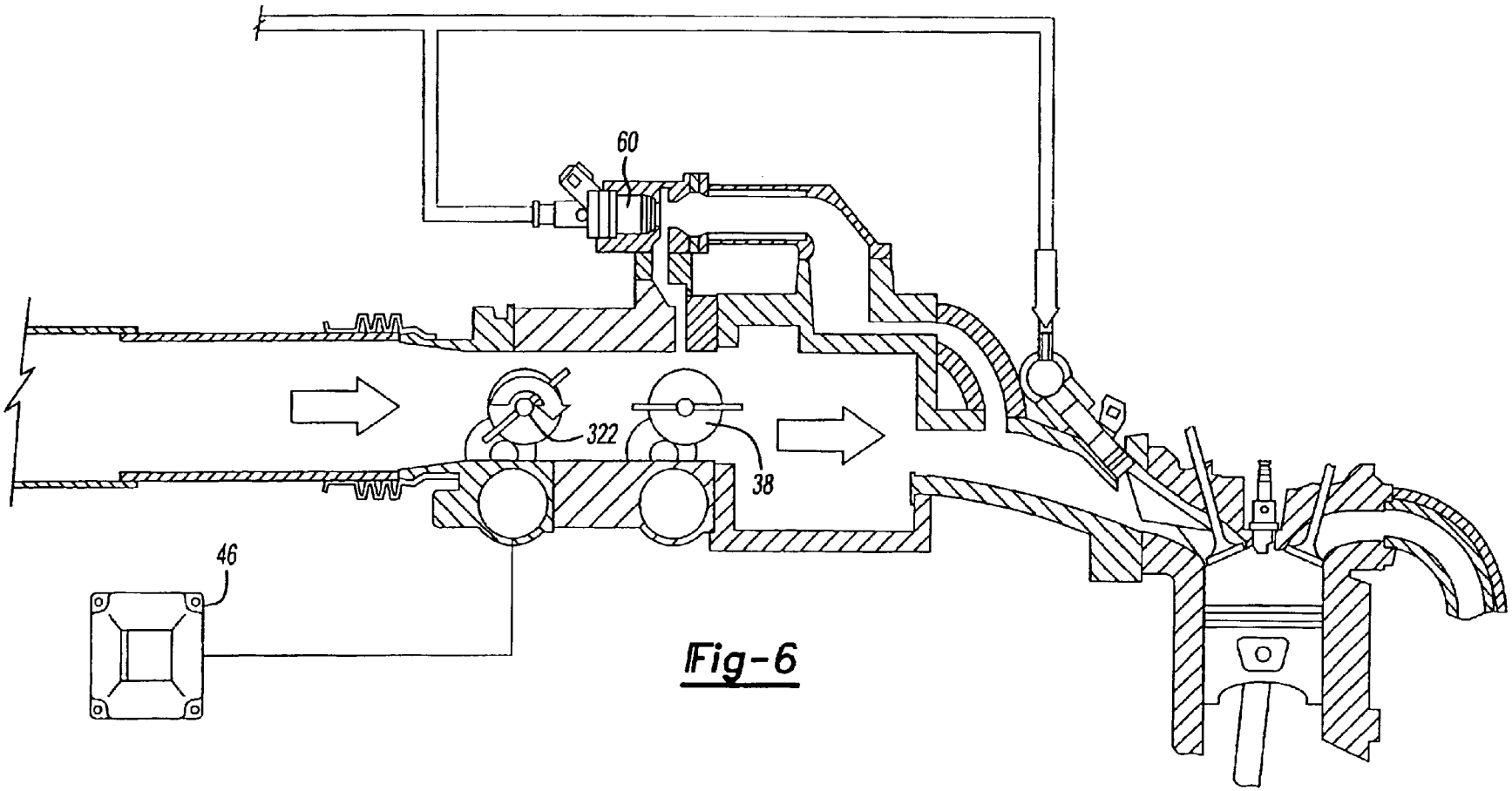
FIG. 6 is a view similar to FIG. 5, but illustrating the system in a non-idle condition.

With reference now to FIGS. 5 and 6, a still further embodiment of a fuel delivery system 320 of the present invention is shown in which, as before, the first electronically controlled throttle valve 38 is operatively disposed in series within the intake manifold 34. The throttle valve 38, as before, is variably opened between its closed position, illustrated in FIG. 5, and a more open position, illustrated in FIG. 6, by the ECU 46.

Unlike the previously described embodiments of the invention, the embodiment illustrated in FIGS. 5 and 6 includes a second electronically controlled throttle valve 322 which is positioned downstream from the first throttle valve 38 and immediately downstream from the inlet 34 of the bypass passageway 32. The throttle valve 322 thus serves to divert air through the bypass passageway 32 when in its closed position (FIG. 5) or alternately allow air to flow past the throttle valve 38 when in its open position (FIG. 6). The second throttle valve 322 is variably movable between an open position (FIG. 6) and a substantially closed position (FIG. 5) by the ECU 46. In practice, the first and second electronically controlled throttle valves 38 and 322 control the air flow to the engine during all operating conditions under control of the ECU 46.

Figure 7:
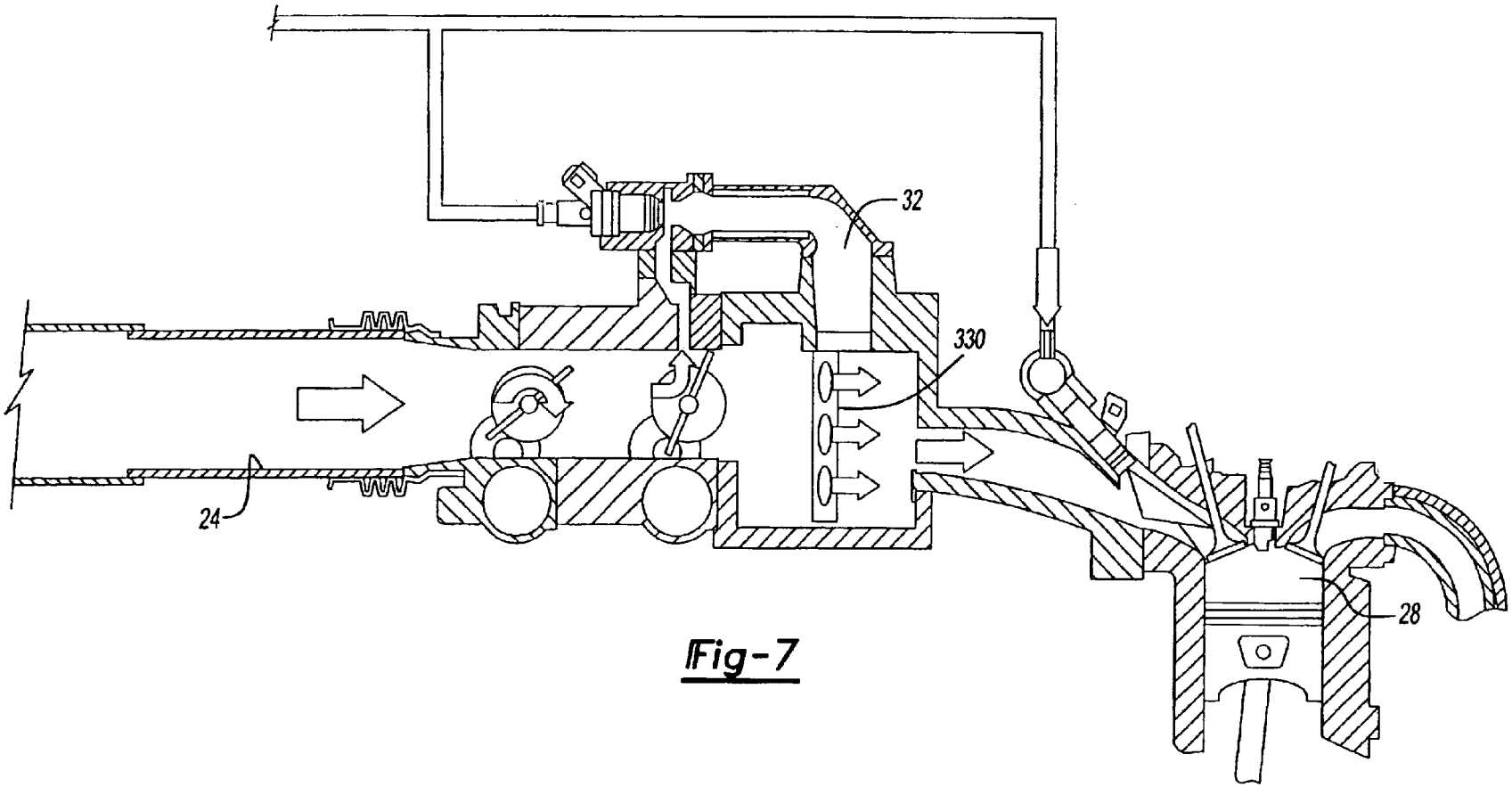
FIG. 7 is a view similar to FIG. 5, but illustrating a modification thereof.

With reference now to FIGS. 5 and 7, in FIG. 5 all air flow through the bypass passageway 32, including any fuel injected by the cold start fuel injector 60, is introduced into the intake manifold 24 through the outlet 36 upstream from the engine intake valve 30. In a modification illustrated in FIG. 7, however, a vapor/air mixing apparatus 330 is employed to introduce the air/fuel mixture from the bypass passageway 32. Preferably, the mixing apparatus 330 includes a multi-hole mixer which introduces the air/fuel mixture from the bypass passageway through small holes across substantially the entire area of the intake manifold 24. Such mixing enhances fuel vaporization prior to its introduction to the engine combustion chamber 28.

Figure 8:
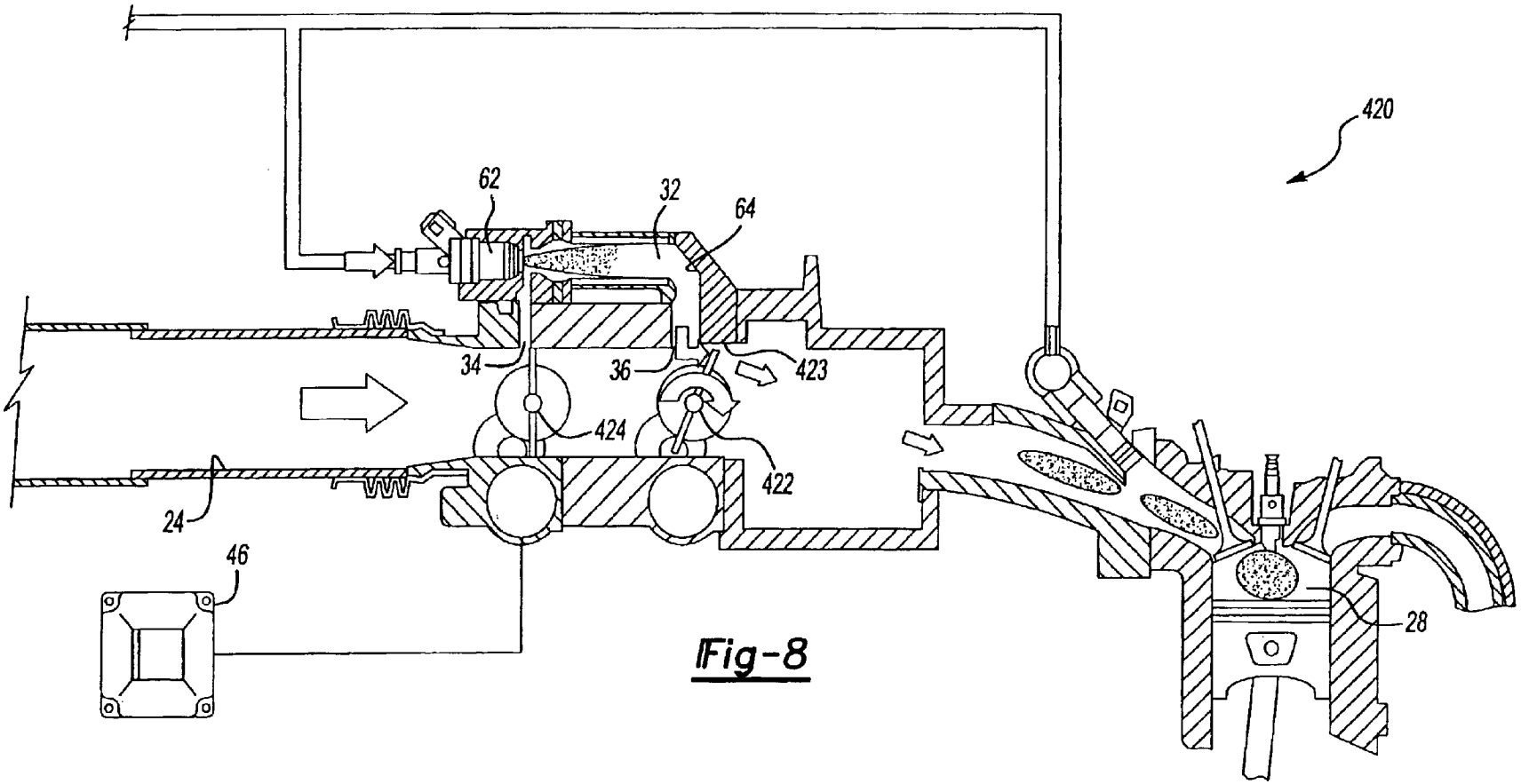
FIG. 8 is a diagrammatic view of a still further preferred embodiment of the present invention in an idle condition.
Figure 9:
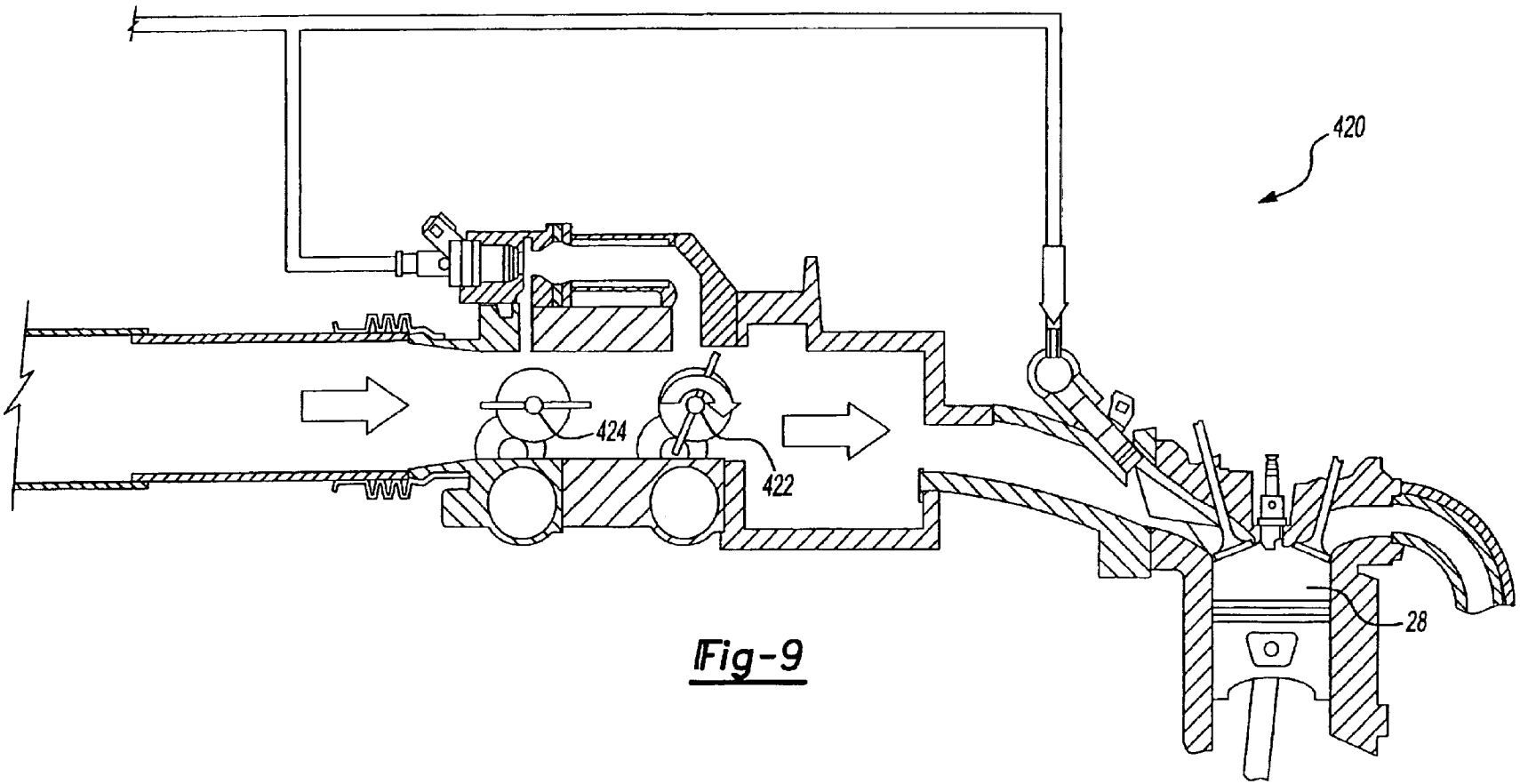
FIG. 9 is a view similar to FIG. 8, but illustrating a non-idling condition.

With reference now to FIGS. 8 and 9, a still further preferred embodiment of the fuel delivery system 420 of the present invention is there shown. The fuel delivery system 420 includes a first electronically controlled throttle valve 422 and a second electronically controlled throttle valve 424 which are fluidly disposed in series within the intake manifold 24. Unlike the previously described embodiments of the invention, however, the first throttle valve 422 is aligned with the outlet 36 of the bypass passageway 32. Thus, when in its closed or nearly closed position (FIG. 8), a throttle plate 423 of the throttle valve 422 is positioned immediately downstream from the bypass passageway outlet 36.

Conversely, a throttle plate 425 of the second throttle valve 424 is positioned immediately downstream from the inlet 34 to the bypass passageway 32. The ECU 46 controls the actuation, i.e. degree of opening, of both throttle valves 422 and 424 to control the air flow through both the intake manifold 24 as well as the bypass passageway 32 to achieve the desired performance.

The cold start fuel injector 62 optionally injects fuel into the bypass passageway 32, as before, under control by the ECU 46. The electrical heater 64 within the bypass passageway 32 and optionally associated with the throttle valve 422 enhances the vaporization of the fuel.

FIG. 8 depicts the operation of the fuel control system 420 in an idle condition. In such an idle condition, the throttle valve 424 is in a substantially closed position thus diverting air into the bypass passageway 32. Modulation of the first throttle valve 422 controls the air flow to the engine combustion chamber 28 as well as the air/fuel mixture.

Conversely, FIG. 9 depicts the operation of the fuel delivery system 420 in a non-idle mode. During a non-idle mode, the throttle valve 424 is moved to its fully open position while the throttle valve 422 under control by the ECU 46 controls the air delivery to the engine combustion chamber 28.

Figure 10:
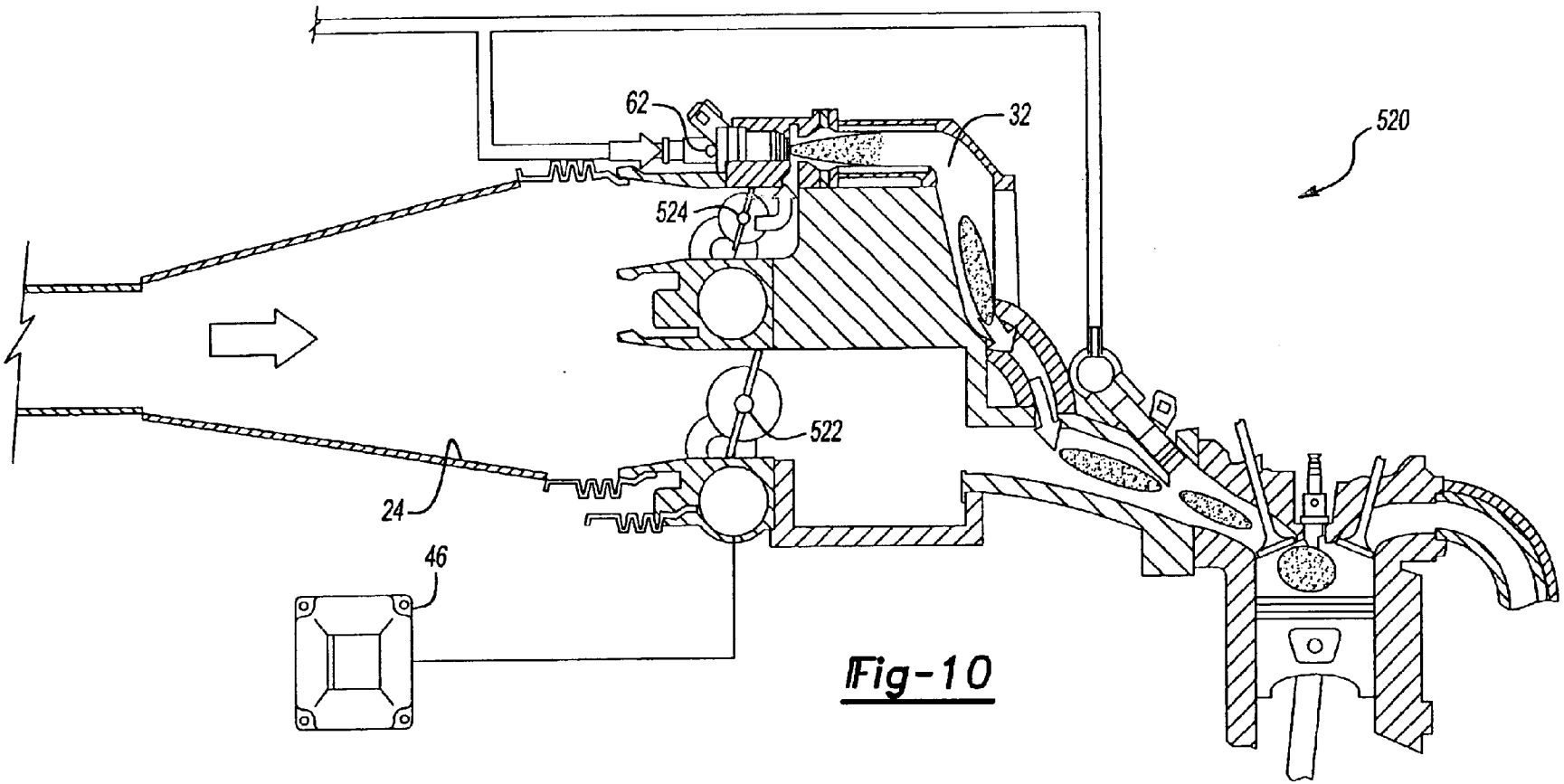
FIG. 10 is a diagrammatic view illustrating still a further preferred embodiment of the present invention.

With reference now to FIG. 10, a still further modification of a fuel delivery system 520 of the present invention is there shown. The system 520 includes a first electronically controlled throttle valve 522 which is disposed in series with the intake manifold 24. The ECU 46 controls the actuation and thus the angle of opening of the throttle valve 522 during non-idle engine conditions in the previously described manner.

The fuel delivery system 520, however, further includes a second electronically controlled throttle valve 524 which is mounted within the intake manifold 24 in parallel with the first throttle valve 522. Additionally, the second throttle valve 22 is fluidly connected in series with the bypass passageway 32 and, accordingly, controls the air flow through the bypass passageway 32.

In operation, the ECU 46 controls the actuation of the throttle valves 522 and 524 during idle and other engine conditions to provide the desired air flow through the bypass passageway 32 and intake manifold 24. The cold start fuel injector 62 optionally provides fuel to the air flow through the bypass passageway 32 during a cold engine operating condition.

Figure 11:
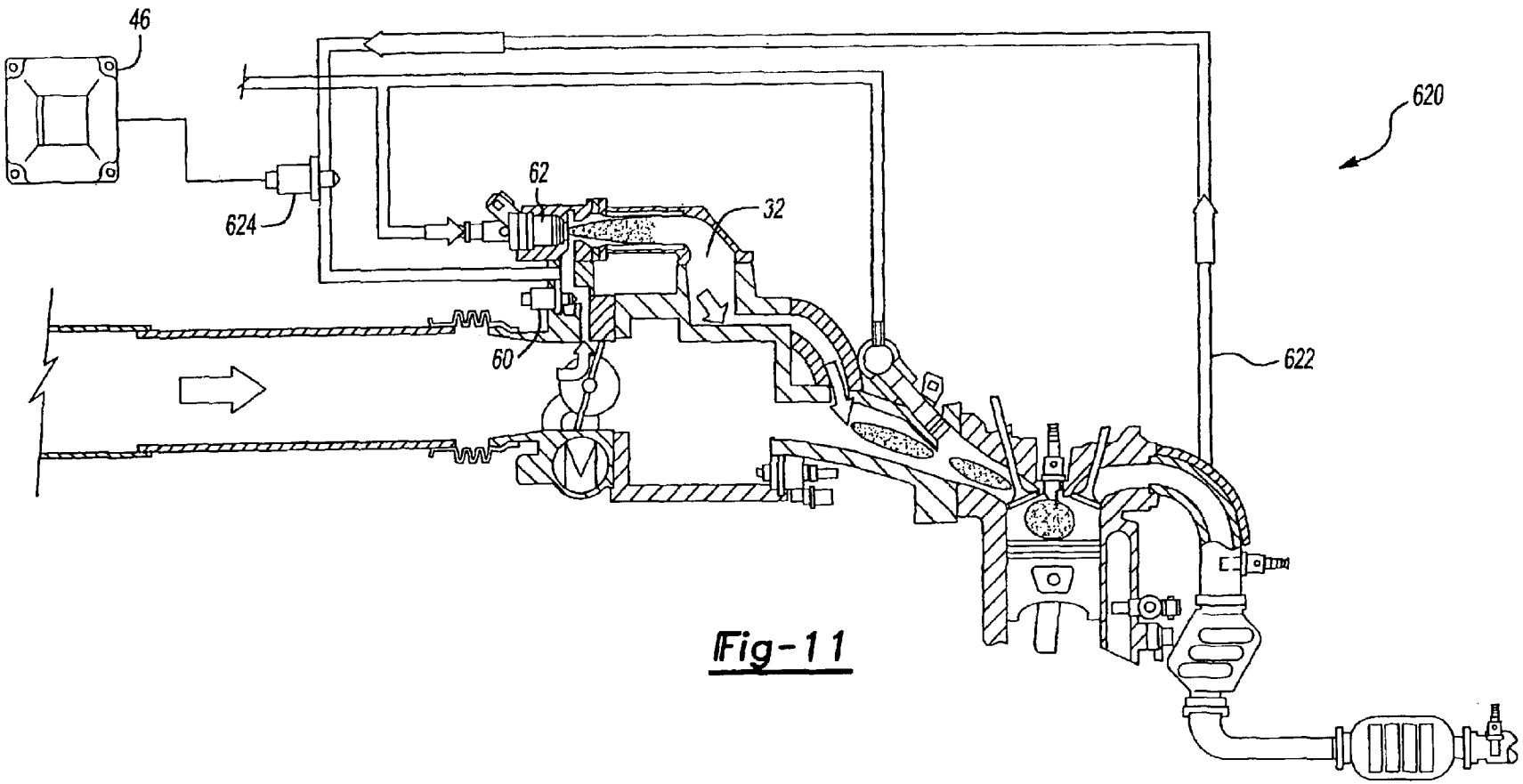
FIG. 11 is a diagrammatic view similar to FIG. 4, but illustrating a modification thereof.

With reference now to FIG. 11, a still further preferred embodiment of the fuel delivery system 620 of the present invention is shown. The system 620 illustrated in FIG. 11 is substantially identical to the fuel delivery system 20 depicted in FIG. 1. However, unlike the system 20 depicted in FIG. 1, an exhaust gas passageway 622 fluidly connects a portion of the engine exhaust to the bypass passageway 32 downstream from the idle speed control valve 60. An exhaust gas recirculation valve 624 is fluidly connected in series with the exhaust gas recirculation passageway 22 to control the recirculation of exhaust gases through the bypass passageway 32. Thus, when the exhaust recirculation valve 624 is closed, there is no recirculation of exhaust gases through the bypass passageway 32. Conversely, when the exhaust gas recirculation valve 24 is open, exhaust gases flow through the exhaust gas recirculation passageway 622 and into the bypass passageway 32 downstream from the idle speed control valve 60 and, preferably, immediately upstream from the cold start fuel injector 62. The ECU 46 controls the actuation of the exhaust gas recirculation valves 624.

Figure 12:
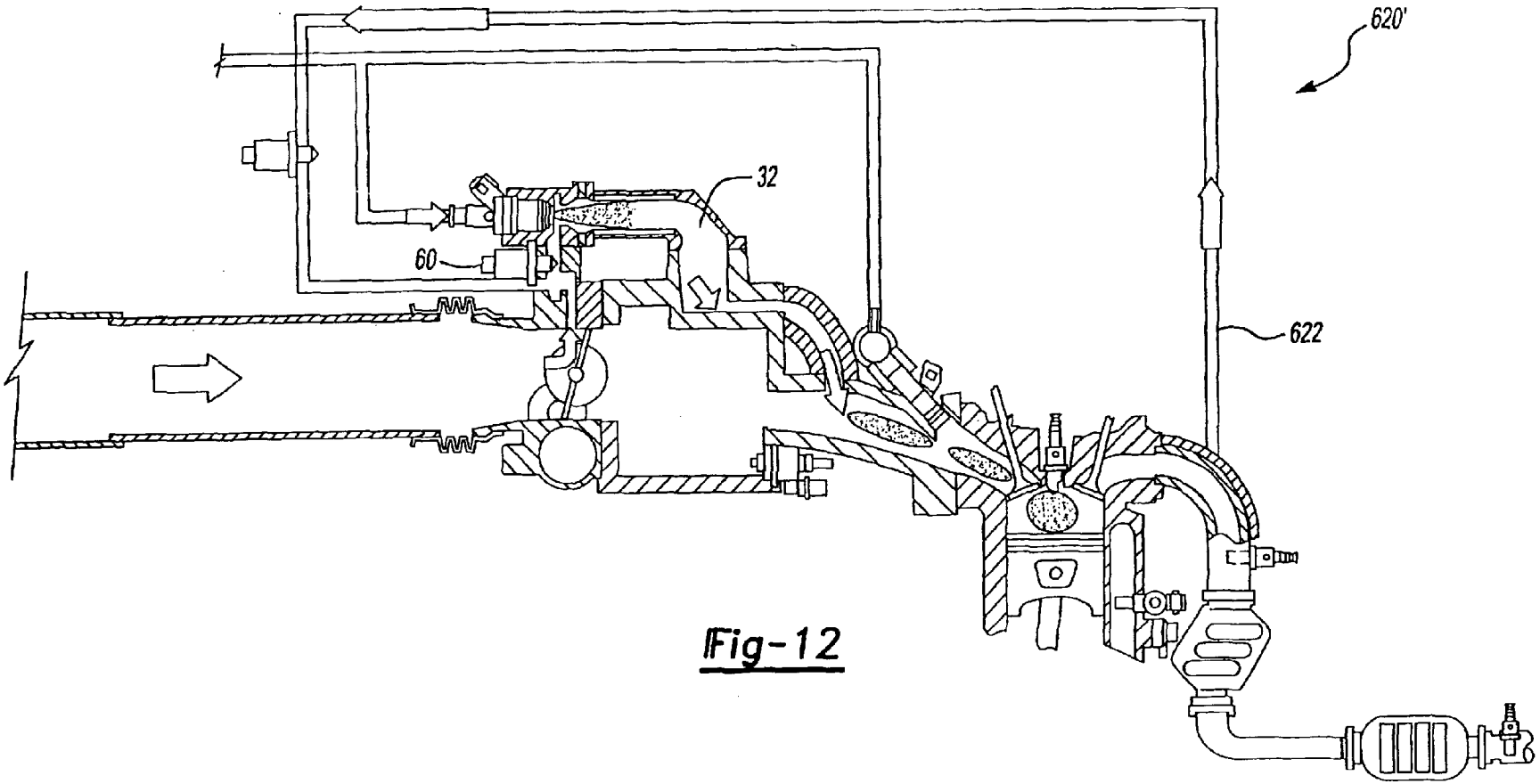
FIG. 12 is a diagrammatic view similar to FIG. 11, but illustrating a modification thereof.

A modification to the fuel delivery system 620 of FIG. 11 is shown as the fuel delivery system 620' in FIG. 12. The system 620' of FIG. 12 differs from the system 620 of FIG. 11 only in that the exhaust gas recirculation passageway 622 is fluidly connected to the bypass passageway 32 upstream from the idle speed control valve 60. Thus, the system 620' actively controls the amount of exhaust gases introduced by recirculation into the bypass passageway 32. As such, more accurate control of the exhaust gas recirculation may be achieved.

Figure 13:
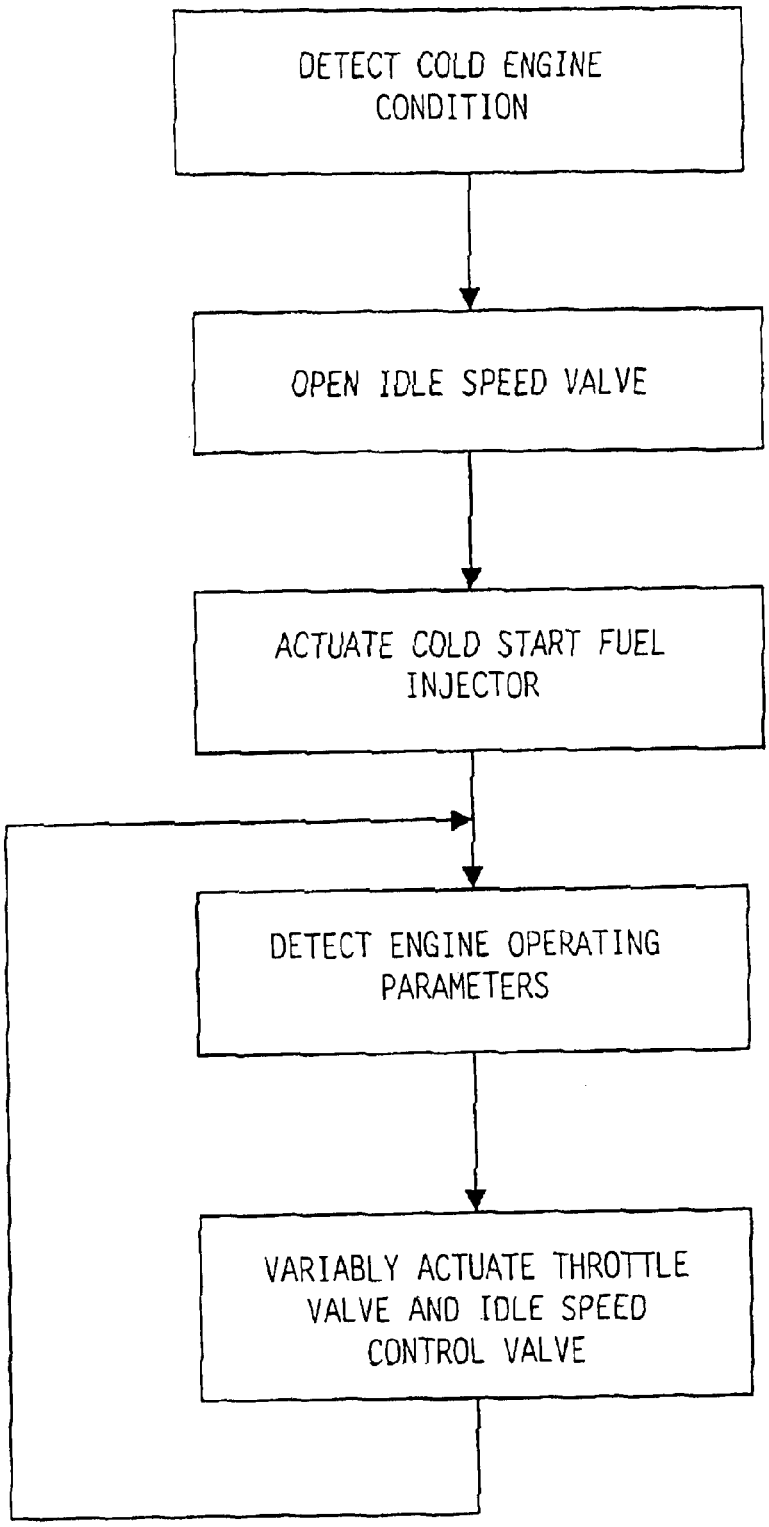
FIG. 13 is a block view illustrating the preferred method of the present invention.

With reference now to FIG. 13, a preferred method of fuel delivery is shown for use with an internal combustion engine having an electronically controlled throttle valve and a bypass gas flow passageway extending from a position upstream from the electronically controlled throttle valve to a position downstream from the electronically controlled throttle valve. An idle speed control valve is disposed in series with the bypass gas flow passageway while a cold start fuel injector is operatively coupled with the bypass gas flow passageway and, upon actuation, injects fuel into the bypass gas flow passageway. An electronic control unit (ECU) controls the actuation of the electronically controlled throttle valve, the idle speed control valve and the cold start fuel injector.

At step 700 the ECU detects a cold engine condition. Any conventional means, such as a coolant temperature sensor, may be used to determine a cold engine condition. Step 700 then proceeds to step 702.

At step 702 the ECU actuates the idle speed control valve to initiate air flow through the bypass gas flow passageway. The idle speed control valve may be either an on/off valve or a valve that may be variably opened by the ECU. Step 702 then proceeds to step 704.

At step 704 the ECU actuates the cold start fuel injector to inject fuel into the bypass gas flow passageway. The fuel injection at step 704 may be either continuous or at a duty cycle controlled by the ECU. Additionally, heaters in the bypass gas flow passageway may be employed to enhance the vaporization of the fuel. Step 704 then proceeds to step 706.

At step 706 the ECU receives input signals indicative of engine operating parameters. Such sensors may include oxygen sensors in communication with the exhaust gas stream, engine coolant temperature, etc. Step 706 then proceeds to step 708.

At step 708 the ECU generates output signals to both the electronically controlled throttle valve and the idle speed control valve using preprogrammed algorithms to control the air/fuel ratio of the combustible charge delivered to the engine to both minimize noxious emissions and maximize engine efficiency. Step 708 then branches back to step 706 and steps 706 and 708 are reiterated until a warm engine condition is achieved.

From the foregoing, it can be seen that the present invention provides a novel fuel delivery system for an internal combustion engine which achieves precise fuel delivery control during all engine operating conditions. Having described our invention, however, many modifications thereto will become apparent to those skilled in the art to which it pertains without deviation from the spirit of the invention as defined by the scope of the appended claims.

We claim:

1. A fuel delivery system for an internal combustion engine of the type having an intake manifold selectively fluidly connected to a combustion chamber and a bypass gas flow passageway having an inlet open to the intake manifold and an outlet open to the intake manifold downstream for the inlet, said system comprising:

an electronically controlled throttle valve operatively disposed in the intake manifold, said electronically controlled throttle valve being movable between an open and a closed position in response to electronic signals to control air flow through the intake manifold, an idle speed control valve operatively disposed in the bypass gas flow passageway, said idle speed control valve being movable between an open and a closed position to control air flow through the bypass gas flow passageway, a fuel injector operatively positioned in the bypass gas flow passageway which, upon actuation in response to electronic signals, injects fuel into the bypass gas flow passageway, and a control system which generates electronic signals which controls the actuation of both said electronically controlled throttle valve and said idle speed control valve between their respective open and closed positions and also simultaneously controls actuation of said fuel injector in said bypass gas flow passageway.

2. The invention as defined in claim 1 and comprising a heater in the bypass gas flow passageway.

3. The invention as defined in claim 1 wherein said idle speed control valve comprises a substantially linear flow control valve.

4. The invention as defined in claim 1 wherein said idle speed control valve comprises an on/off flow control valve.

5. The invention as defined in claim 1 and comprising an exhaust gas recirculation passageway fluidly connected to the bypass gas flow passageway upstream from said idle speed control valve.

6. The invention as defined in claim 5 and comprising an exhaust gas valve operatively disposed in series with the exhaust gas recirculation passageway, said control system being connected to and controlling actuation of said exhaust gas valve.

7. The invention as defined in claim 1 and comprising an exhaust gas recirculation passageway fluidly connected to the bypass gas flow passageway downstream from said idle speed control valve.

8. The invention as defined in claim 7 and comprising an exhaust gas valve operatively disposed in series with the exhaust gas recirculation passageway, said control system being connected to and controlling actuation of said exhaust gas valve.

9. The invention as defined in claim 1 wherein said throttle valve is positioned immediately downstream from the inlet to the bypass gas flow passageway.

10. The invention as defined in claim 1 wherein the bypass passageway is formed through a housing and a portion of the intake manifold is formed through the housing, wherein the housing is a one piece construction.

11. For use in conjunction with an internal combustion engine having an electronically controlled throttle valve, a bypass gas flow passageway extending from a point upstream from the electronically controlled throttle valve to a point downstream from the electronically controlled throttle valve, an idle speed controlled valve operatively connected in series with the bypass gas flow passageway, a cold start fuel injector operatively disposed to inject fuel into the bypass gas flow passageway upon actuation and an electronic control unit to control the actuation of the electronically controlled throttle valve, the idle speed control valve and the cold start fuel injector, a method of fuel delivery during a cold engine condition comprising the steps of:

detecting a cold engine condition, opening the idle speed control valve, electronically actuating the cold start fuel injector, detecting engine operating parameters, and actuating the electronically controlled throttle valve and idle speed control valve to reduce engine emissions.

12. For use in conjunction with an internal combustion engine having an electronically controlled throttle valve, a bypass gas flow passageway extending from a point upstream from the electronically controlled throttle valve to a point downstream from the electronically controlled throttle valve, an idle speed controlled valve operatively connected in series with the bypass gas flow passageway, a cold start fuel injector operatively disposed to inject fuel into the bypass gas flow passageway upon actuation and an electronic control unit to control the actuation of the electronically controlled throttle valve, the idle speed control valve and the cold start fuel injector, a method of fuel delivery during a cold engine condition comprising the steps of:

detecting a cold engine condition, opening the idle speed control valve, electronically actuating the cold start fuel injector, detecting engine operating parameters, and simultaneously actuating the electronically controlled throttle valve and idle speed control valve to reduce engine emissions.

* * * * *